US009595404B2

(12) United States Patent
Zheng et al.

(10) Patent No.: US 9,595,404 B2
(45) Date of Patent: Mar. 14, 2017

(54) ELECTRICAL SWITCHING APPARATUS INCLUDING AN ADJUSTABLE DAMPER ASSEMBLY

(71) Applicants: Fangwei Zheng, Shanghai (CN); Hairong Chen, Shanghai (CN); Hao Wu, Shanghai (CN); Zongfeng Ye, Shanghai (CN); GENERAL ELECTRIC COMPANY, Schenectady, NY (US)

(72) Inventors: Fangwei Zheng, ShangHai (CN); Hairong Chen, ShangHai (CN); Hao Wu, ShangHai (CN); Zongfeng Ye, ShangHai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/905,984

(22) PCT Filed: Jul. 19, 2013

(86) PCT No.: PCT/CN2013/079666

§ 371 (c)(1),
(2) Date: Jan. 19, 2016

(87) PCT Pub. No.: WO2015/006965

PCT Pub. Date: Jan. 22, 2015

(65) Prior Publication Data

US 2016/0155579 A1 Jun. 2, 2016

(51) Int. Cl.

| | |
|---|---|
| ***H01H 33/66*** | (2006.01) |
| ***H01H 3/60*** | (2006.01) |
| ***H01H 33/662*** | (2006.01) |

(52) U.S. Cl.

CPC ..... *H01H 3/605* (2013.01); *H01H 33/66* (2013.01); *H01H 33/66207* (2013.01)

(58) Field of Classification Search

CPC ..... H01H 33/66; H01H 3/60; H01H 33/596; H01H 9/548; H01H 2003/268;

(Continued)

(56) References Cited

U.S. PATENT DOCUMENTS 4,612,429 A * 9/1986 Milianowicz ..... F16F 7/00 200/288

5,025,236 A 6/1991 Miura et al.

(Continued)

FOREIGN PATENT DOCUMENTS

CN 1185014 A 6/1998
CN 1440559 A 9/2003

(Continued)

OTHER PUBLICATIONS

Yu Li et al., "Relationship Between Displacement Characteristics of a 126kv Vacuum Circuit Breaker and Spring Type Operating Mechanism",Discharges and Electrical Insulation in Vacuum, 2008. ISDEIV 2008. 23rd International Symposium on , Issue Date:Sep. 15-19, 2008, vol. 1, pp. 137-140.

(Continued)

*Primary Examiner* — Truc Nguyen
(74) *Attorney, Agent, or Firm* — GE Global Patent Operation; Stephen G. Midgley

(57) ABSTRACT

An electrical switching apparatus including a housing, a circuit interrupter mechanism movably disposed in the housing, and a damper assembly. The damper assembly includes a bracket that secures the damper assembly to the housing. A damper body is adjustably secured to the bracket. A stopper is coupled to the damper body and arranged to limit relative movement of the circuit interrupter mechanism with respect to the damper assembly. A damper rod extends through an opening in the stopper and has a surface that is arranged to interact with the circuit interrupter mechanism.

(Continued)

The damper rod is arranged to damp movement of the circuit interrupter mechanism with respect to the damper body when the circuit interrupter mechanism is in contact with the surface of the damper rod.

10 Claims, 2 Drawing Sheets

(58) Field of Classification Search
CPC .... H01H 2300/03; H01H 33/36; H01H 39/00; H01H 3/02; H01H 50/54; H01H 71/025; H01H 9/542; H01H 1/0015; H01H 1/06; H01H 1/365
See application file for complete search history.

(56) References Cited

U.S. PATENT DOCUMENTS

| | | | | |
|---|---|---|---|---|
| 5,349,712 | A | 9/1994 | Kawashima et al. | |
| 6,670,872 | B2 | 12/2003 | Kurzmann | |
| 7,098,418 | B1 * | 8/2006 | Yamada | H01H 1/0015 218/120 |
| 7,633,364 | B2 | 12/2009 | Moffat et al. | |
| 7,881,044 | B2 | 2/2011 | Jacobsen et al. | |
| 8,284,002 | B2 | 10/2012 | Heller et al. | |
| 8,330,065 | B2 | 12/2012 | Ohda et al. | |
| 8,395,067 | B2 | 3/2013 | Marushima et al. | |
| 2007/0080766 | A1 * | 4/2007 | Sisley | H01H 3/60 335/172 |
| 2008/0296138 | A1 * | 12/2008 | Chen | H01H 71/44 200/400 |
| 2010/0309609 | A1 * | 12/2010 | Jacobsen | H02B 11/12 361/606 |
| 2011/0180979 | A1 | 7/2011 | Ishibashi et al. | |
| 2013/0035170 | A1 | 2/2013 | Uehara | |

FOREIGN PATENT DOCUMENTS

| | | | | |
|---|---|---|---|---|
| CN | 201796822 | U | 4/2011 | |
| CN | 102575738 | A | 7/2012 | |
| CN | 202549643 | U | 11/2012 | |
| DE | 19959794 | A1 * | 6/2001 | H01H 3/60 |
| JP | 06028954 | A * | 2/1994 | H01H 3/60 |
| JP | 9180592 | A | 7/1997 | |
| JP | 9265847 | A | 10/1997 | |
| JP | 2001023480 | A | 1/2001 | |

OTHER PUBLICATIONS

International Search Report and Written Opinion dated May 4, 2014 which was issued in connection with PCT Patent Application No. PCT/CN2013/079666 which was filed on Jul. 19, 2013.
Unofficial translation of Chinese Office Action and Search Report issued in connection with corresponding CN Application No. 201380078353.7 dated Nov. 30, 2016.

* cited by examiner

ELECTRICAL SWITCHING APPARATUS INCLUDING AN ADJUSTABLE DAMPER ASSEMBLY

BACKGROUND OF THE INVENTION

The subject matter disclosed herein relates to an electrical switching apparatus and more particularly to an electrical switching apparatus having a damper assembly.

Electrical switching apparatuses and switchgears are known in the art for interrupting the flow of electrical current within an electric circuit. Such electrical switching apparatuses include vacuum circuit breakers, among other types of circuit breakers and electrical switches. The interruption created by an electrical switching apparatus can be caused by disconnecting two electrical contacts by physically moving the contacts away from each other. To this end, a circuit interrupter mechanism, such as a shaft, linkage, or combination thereof, that is mechanically coupled to one or more of the electrical contacts can be moved in order to disconnect the contacts. In a vacuum circuit breaker, the electrical contacts are isolated within a vacuum. Movement of the circuit interrupter mechanism can be triggered by a spring or other energy storage device.

A damper assembly can be included to help improve the operating characteristics of the electrical switching apparatus regardless of type. The damper assembly can affect characteristics of the apparatus such as opening speed, over travel, and bounce or rebound of the circuit interrupter mechanism. However, damper assemblies must be specifically chosen or laboriously adjusted to properly set the characteristics for any given electrical switching apparatus. The industry would well receive a damper assembly that enables the operating characteristics of an electrical switching apparatus to be accurately and quickly adjusted.

BRIEF DESCRIPTION OF THE INVENTION

According to one aspect of the invention, an electrical switching apparatus includes a housing, a circuit interrupter mechanism movably disposed in the housing, and a damper assembly. The damper assembly includes a bracket that secures the damper assembly to the housing. A damper body is adjustably secured to the bracket. A stopper is coupled to the damper body and arranged to limit relative movement of the circuit interrupter mechanism with respect to the damper assembly. A damper rod extends through an opening in the stopper and has a surface that is arranged to interact with the circuit interrupter mechanism. The damper rod is arranged to damp movement of the circuit interrupter mechanism with respect to the damper body when the circuit interrupter mechanism is in contact with the surface of the damper rod.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
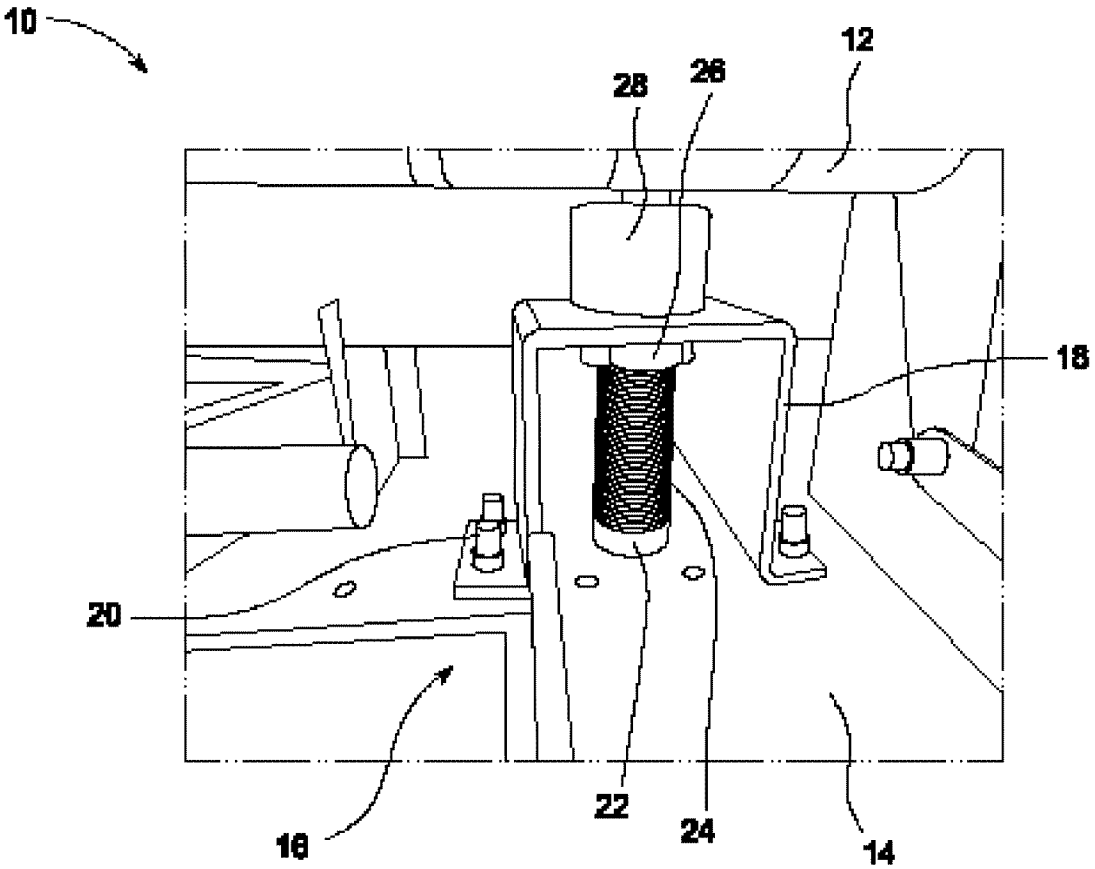
FIG. 1 is a perspective view of an electrical switching apparatus having a damper assembly engaged with a circuit interrupter mechanism according to one embodiment disclosed herein.

Referring to FIG. 1, an electrical switching apparatus or switchgear is partially illustrated and generally referred to with numeral 10. The electrical switching apparatus 10 includes a circuit interrupter mechanism 12 that is movable within a housing 14 in order to interrupt current flow through an electrical circuit of which the electrical switching apparatus 10 is a part. For example, movement of the circuit interrupter mechanism 12 can break an electrically conductive connection between two electrical contacts by physically moving the contacts away from each other. The circuit interrupter mechanism 12 can take the form of a shaft or linkage, and can be movable by way of a spring or other stored energy source that is selectively releasable, e.g., via a locking device, as desired or automatically upon detection of a fault within the circuit. In one embodiment, the electrical switching apparatus 10 is vacuum-isolated, i.e., is or includes a vacuum circuit breaker.

The electrical switching apparatus 10 includes a damper assembly 16 for damping movement of the circuit interrupter mechanism 12. In one embodiment, the damper assembly 16 damps the movement of the circuit interrupter mechanism 12 during an opening operation of the electrical switching apparatus 10. The opening operation can include the disengagement of electrical contacts of the electrical switching apparatus 10 from each other by moving one of the electrical contacts with the circuit interrupter mechanism 12 (e.g., via mechanical connection of the electrical contact to the circuit interrupter mechanism 12). The electrical contact can be directly connected to the circuit interrupter mechanism 12 or indirectly via another mechanical linkage. By damping the movement of the circuit interrupter mechanism 12, operation of the circuit interrupter mechanism 12 can be controlled to desirably set, adjust, or influence operating characteristics of the electrical switching apparatus 10. For example, the damper assembly 16 can be used to regulate the rebound or bounce, open speed, over travel, or other operating characteristics of the circuit interrupter mechanism 12 during an opening operation of the electrical switching apparatus 10.

The damper assembly 16 includes a bracket 18 that is securable to the housing 14 via a set of fasteners 20. The fasteners 20 are illustrated in the form of threaded fasteners, although the bracket 18 can be connected to the housing 14 via welds, clips, rivets, or in another desired manner. A damper body 22 is adjustably securable to the bracket 18. By adjustably securable it is meant that while the damper body 22 can be secured to the bracket 18, the damper body 22 can be released and resecured or otherwise repositioned in order to change or adjust the position of the damper body 22 with respect to the bracket 18. In the illustrated embodiment, the damper body 22 includes threads 24 that are complementarily received by the bracket 18 for enabling the damper body 22 to be releasably secured to the bracket 18. Specifically with respect to the illustrated embodiment, the bracket 18 includes a threaded boss 26, e.g., a threaded nut, that is immovably affixed to the bracket 18, e.g., via welds, such that threaded connection of the damper body 22 to the threaded boss 26 connects the damper body 22 to the bracket 18. In one embodiment, the bracket 18 includes a threaded boss and directly connects to the damper body 22 via the threads 24.

The damper assembly 16 also includes a stopper 28 that acts as a hard stop that sets a limit to the movement of the circuit interrupter mechanism 12 relative to damper assembly 16. In the illustrated embodiment, the stopper 28 is also connected the damper body 22 via threaded connection with the threads 24, as can be seen in the partial cross-section of FIG. 2. The stopper 28 can also be utilized to help hold the damper body 22 in place with respect to the bracket 18. For example, the damper body 22 can first be connected, e.g., threaded, to the bracket 18, and then the stopper 28 fully threaded onto the damper body 22 until the stopper 28 contacts or "bottoms out" against the bracket 18. In this way, the stopper 28 can help support the damper body 22 via the physical contact of the stopper 28 with the bracket 18 and resist unintended or undesired movement of the damper body 22 with respect to the bracket 18 during operation of the electrical switching apparatus 10 or movement of the circuit interrupter mechanism 12.

Figure 3:
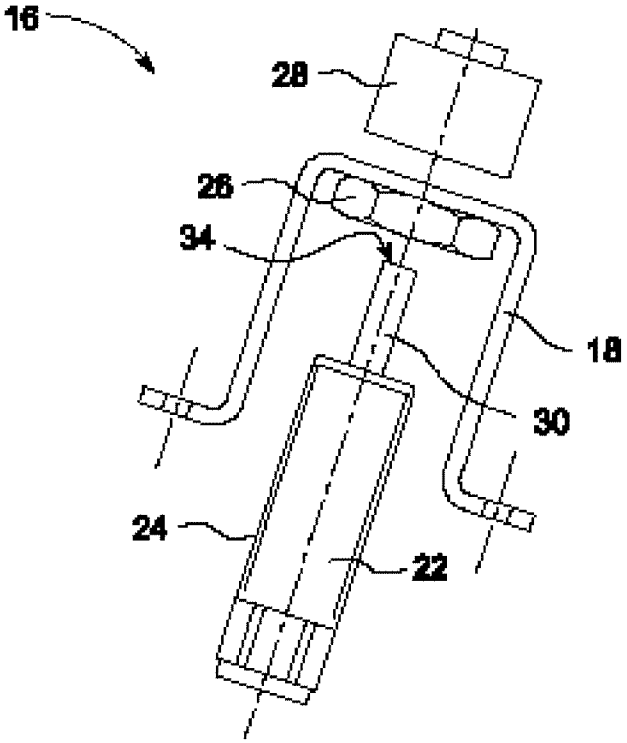
FIG. 3 is an exploded side view of the damper assembly of FIG. 1.
Figure 2:
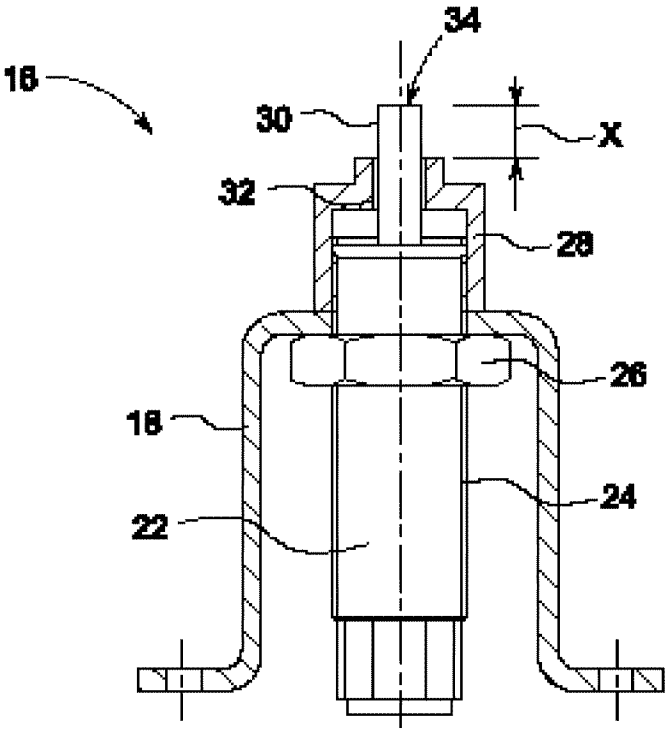
FIG. 2 is a partial cross-sectional side view of the damper assembly of FIG. 1.

The damper assembly 16 includes a damper rod 30 that is best shown in FIGS. 2 and 3. The damper rod 30 is inserted into the damper body 22 such that the damper rod 30 exhibits damped movement with respect to the damper body 22. For example, the damper body 22 can include oil, air, or another fluid forcibly displaceable by the rod 30 as the rod 30 is forced or moved further into the damper body 22. In one embodiment, the damper body 22 includes a spring or other resilient member that resists movement of the damper rod 30 further into the damper body 22 in order to provide damped movement of the damper rod 30. The damper rod 30 extends from the damper body 22 and through an opening 32 in the stopper 28 in order to contact the circuit interrupter mechanism 12. By its contact with the circuit interrupter mechanism 12, the damper rod 30 enables the damper assembly 16 to provide the aforementioned ability to damp movement of the circuit interrupter mechanism 12, e.g., during an opening operation of the circuit interrupter mechanism 12.

The adjustable connection of the damper body 22 to the bracket 18, e.g., via the threads 24, enables a distance X, shown in FIG. 2, to be set. The distance X defines the degree of travel that the damper rod 30 can travel before the circuit interrupter mechanism 12 encounters or "bottoms out" against the stopper 28. In other words, the distance X is defined as the maximum distance between a surface 34 of the damper rod 30 that contacts the circuit interrupter mechanism 12 and the stopper 28. By adjusting the distance X, e.g., via the adjustable connection of the damper body 22 to the bracket 18, the performance of the damper assembly 16 can be modified, e.g., in order to adjust the operating characteristics of the electrical switching apparatus 10 and the circuit interrupter mechanism 12 noted above, e.g., rebound, open speed, over travel, etc. Not only can performance of the damper assembly 16 be accurately set by adjusting the body 22 with respect to the bracket 18, e.g., via the threads 24, but the time needed to fully adjust the aforementioned characteristics of the electrical switching apparatus 10 and the circuit interrupter mechanism 12 is generally minimized.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electrical switching apparatus comprising:

a housing;

a circuit interrupter mechanism movably disposed in the housing; and a damper assembly including:

a bracket, the damper assembly secured to the housing by the bracket;

a damper body adjustably secured to the bracket;

a stopper coupled to the damper body and arranged to limit relative movement of the circuit interrupter mechanism with respect to the damper assembly; and a damper rod extending through an opening in the stopper and having a surface that is arranged to interact with the circuit interrupter mechanism, the damper rod arranged to damp movement of the circuit interrupter mechanism with respect to the damper body when the circuit interrupter mechanism is in contact with the surface of the damper rod.

2. The switch gear system of claim 1, wherein the electrical switching apparatus comprises a vacuum circuit breaker.

3. The electrical switching apparatus of claim 1, wherein the bracket is secured to the housing via fasteners.

4. The electrical switching apparatus of claim 1, wherein adjusting a position of the damper body with respect to the bracket changes a maximum distance between the stopper and the surface of the damper rod that contacts the circuit interrupter mechanism.

5. The electrical switching apparatus of claim 4, wherein the damper body includes threads and is adjustably secured to the bracket with the threads.

6. The electrical switching apparatus of claim 5, wherein the bracket includes a threaded boss immovably affixed to the bracket and the threads of the damper body are received by the threaded boss in order to adjustably secure the damper body to the bracket.

7. The electrical switching apparatus of claim 5, wherein the stopper is threadedly secured to the threads of the damper body.

8. The electrical switching apparatus of claim 6, wherein the threaded boss is welded to the bracket.

9. The electrical switching apparatus of claim 1, wherein the damper body contains a fluid that damps movement of the damper rod relative to the damper body.

10. The electrical switching apparatus of claim 1, wherein the circuit interrupter mechanism includes a shaft, a linkage, or a combination including at least one of the foregoing.

* * * * *